US010191442B2

(12) United States Patent
Kitamura

(10) Patent No.: US 10,191,442 B2
(45) Date of Patent: Jan. 29, 2019

(54) IMAGE FORMING APPARATUS

(71) Applicant: Oki Data Corporation, Tokyo (JP)

(72) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/875,032

(22) Filed: Jan. 19, 2018

(65) Prior Publication Data

US 2018/0217552 A1 Aug. 2, 2018

(30) Foreign Application Priority Data

Jan. 31, 2017 (JP) ..... 2017-015085

(51) Int. Cl.
*G03G 21/12* (2006.01)
*G03G 15/08* (2006.01)

(52) U.S. Cl.
CPC ..... *G03G 21/12* (2013.01); *G03G 15/0875* (2013.01)

(58) Field of Classification Search
CPC . G03G 15/0875; G03G 21/12; G03G 21/1814
See application file for complete search history.

(56) References Cited

U.S. PATENT DOCUMENTS 5,659,837 A * 8/1997 Jo ..... G03G 15/0865 399/111
2005/0220498 A1* 10/2005 Ito ..... G03G 21/105 399/262
2017/0285568 A1* 10/2017 Nishiyama ..... G03G 21/1814

FOREIGN PATENT DOCUMENTS

JP 2003-345116 A 12/2003

* cited by examiner

*Primary Examiner* — Gregory H Curran
(74) *Attorney, Agent, or Firm* — Rabin & Berdo, P.C.

(57) ABSTRACT

An image forming apparatus includes an image forming unit and a cartridge removably attached thereto. The image forming unit includes: a toner image forming unit; and a toner storing portion including a first toner storing portion that stores a first toner, a waste toner storing portion that stores a waste toner, and a movable partition that separates the storing portions. The cartridge includes a second toner storing portion that stores a second toner. The image forming unit includes: a first portion for supplying the first toner in the first toner storing portion to the toner image forming unit; a second portion for supplying the second toner in the second toner storing portion to the toner image forming unit; and a conveying member that conveys the first toner supplied through the first portion and the second toner supplied through the second portion, to the toner image forming unit.

10 Claims, 15 Drawing Sheets

IMAGE FORMING APPARATUS

BACKGROUND OF THE INVENTION

1. Field of the Invention

The present invention relates to an image forming apparatus including a toner cartridge.

2. Description of the Related Art

Japanese Patent Application Publication No. 2003-345116 discloses an image forming apparatus including multiple print process cartridges each provided with a toner cartridge including a first chamber that stores toner, a second chamber that collects waste toner, and a partition that separates the first chamber and second chamber. As the amount of toner in the first chamber decreases, the partition moves and expands the second chamber.

The toner cartridge is provided for each print process cartridge, and replaced when the toner runs out. Thus, a toner cartridge may be replaced before the second chamber is filled with the waste toner. This wastes space and enlarges the apparatus. Further, immediately after a certain toner cartridge is replaced, another toner cartridge may be replaced. This increases the frequency of replacement of the toner cartridges, reducing the usability.

SUMMARY OF THE INVENTION

According to an aspect of the present invention, there is provided an image forming apparatus including an image forming unit and a toner cartridge that is removably attached to the image forming unit. The image forming unit includes: a toner image forming unit that forms a toner image; and a toner storing portion including a first supply toner storing portion that stores a first supply toner, a waste toner storing portion that stores a waste toner, and a movable partition that separates the first supply toner storing portion and the waste toner storing portion. The toner cartridge includes a second supply toner storing portion that stores a second supply toner having the same color as the first supply toner. The image forming unit further includes: a first supply portion for supplying the first supply toner stored in the first supply toner storing portion to the toner image forming unit; a second supply portion for supplying the second supply toner stored in the second supply toner storing portion to the toner image forming unit; and a first conveying member that conveys the first supply toner supplied through the first supply portion and the second supply toner supplied through the second supply portion, to the toner image forming unit.

DETAILED DESCRIPTION OF THE INVENTION

Embodiments of the present invention will now be described with reference to the attached drawings.

First Embodiment

Figure 1:
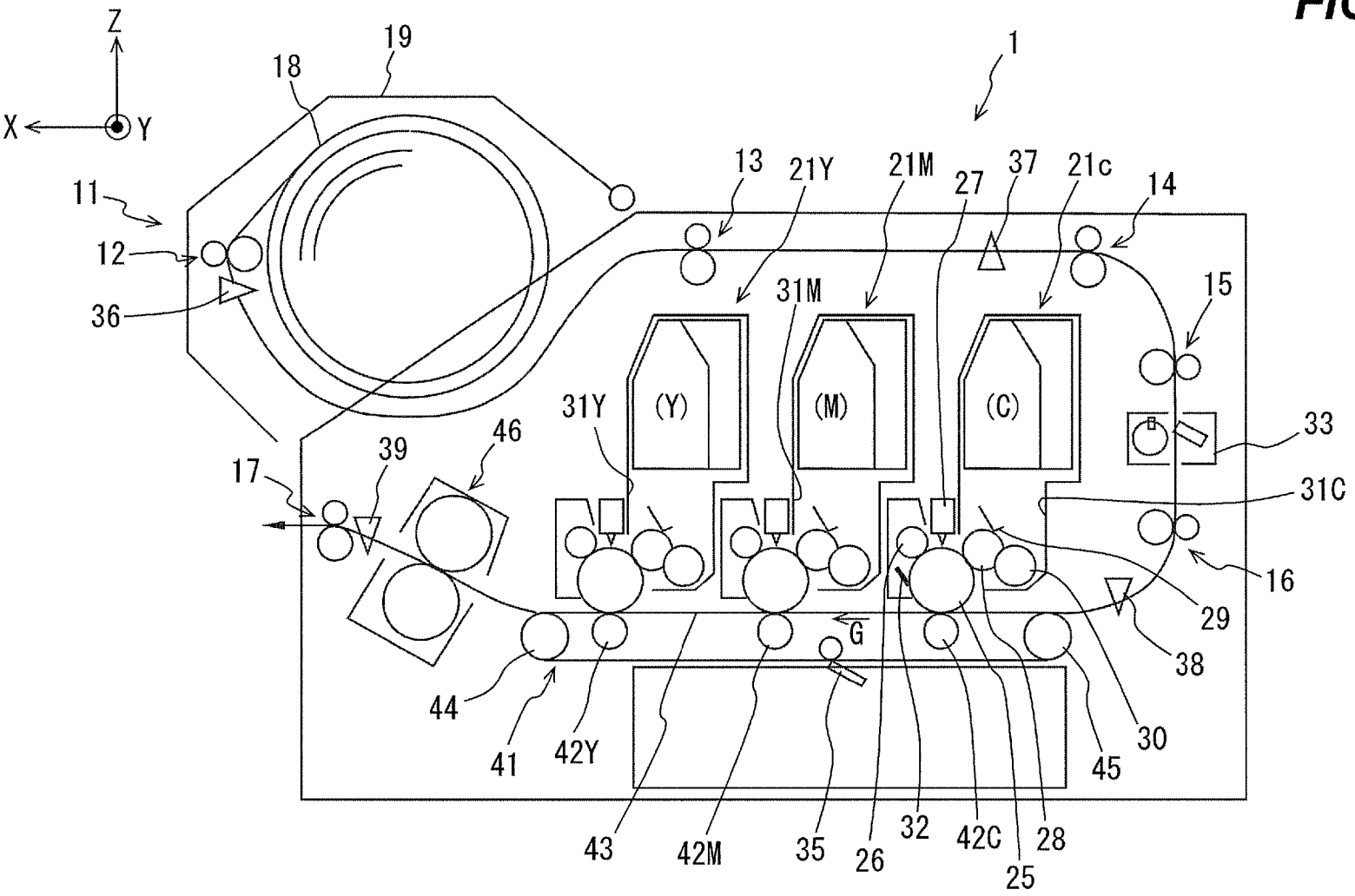
FIG. 1 is a configuration diagram illustrating the main components of an image forming apparatus according to a first embodiment of the present invention.

FIG. 1 is a configuration diagram illustrating the main components of an image forming apparatus 1 according to a first embodiment of the present invention.

As illustrated in FIG. 1, the image forming apparatus 1, which is an electrophotographic color printer, includes a generally C-shaped paper conveying path. A paper roll holder 11 in which a paper roll 18 is set is disposed at an upstream end of the paper conveying path. The paper roll holder 11 includes an openable and closable roll set cover 19 for covering the paper roll 18, a pair of paper feed rollers 12 that feeds a paper sheet from the set paper roll 18 into the paper conveying path, and a paper set sensor 36 for detecting that the paper roll 18 has been set.

The image forming apparatus 1 includes, along the paper conveying path, pairs of conveying rollers 13 to 16 that convey the paper sheet fed by the pair of paper feed rollers 12, a transfer belt unit 41 including a transfer belt 43 that electrostatically attracts and conveys the paper sheet conveyed by the pairs of conveying rollers 13 to 16, a fixing unit 46 that fixes a toner image to the paper sheet, and a pair of discharging rollers 17 that is disposed at a downstream end of the paper conveying path and discharges the paper sheet outside the image forming apparatus 1.

In a direction in which the paper sheet is conveyed, a paper end sensor 37 that detects leading and trailing ends of the paper sheet is disposed after the pair of conveying rollers 13; a cutter unit 33 that cuts the paper sheet is disposed after the pair of conveying rollers 15; a writing sensor 38 that detects a leading end of the cut paper sheet and outputs a detection signal serving as an exposure trigger for exposure devices 27, described later, is disposed after the pair of conveying rollers 16; and a discharge sensor 39 that detects discharge of the cut paper sheet with the toner image fixed thereon is disposed after the fixing unit 46.

The cutter unit 33 is, in this embodiment, a rotary cutter including a rotary blade that rotates in a direction in which the paper sheet travels, and a fixed blade facing the rotary blade. Hereinafter, the paper sheet cut by the cutter unit 33 may be referred to as the recording sheet.

The transfer belt unit 41 includes transfer rollers 42C, 42M, and 42Y, the transfer belt 43, a drive roller 44, a tension roller 45, and a belt cleaner 35. When the transfer rollers 42C, 42M, and 42Y need not be distinguished from each other, they may be referred to simply as the transfer rollers 42. The transfer belt 43 is disposed so that it can move in the direction of arrow G in FIG. 1 while being stretched by the drive roller 44 and tension roller 45. The belt cleaner 35 scrapes off toner remaining on the transfer belt 43.

Image forming units 21C, 21M, and 21Y are aligned in this order from the upstream side to the downstream side in the conveying direction of the recording sheet so that the recording sheet attracted and conveyed by the transfer belt 43 is sandwiched between the image forming units 21C, 21M, and 21Y and the transfer belt unit 41. The image forming units 21C, 21M, and 21Y respectively store toners of cyan (C), magenta (M), and yellow (Y). When the image forming units 21C, 21M, and 21Y need not be distinguished from each other, they will be referred to as the image forming units 21.

In this embodiment, the image forming units 21C, 21M, and 21Y have the same configuration except that they store toners of different colors, so the internal configuration of the image forming unit 21C will be representatively described below. With respect to a certain component, such as one of the image forming units 21, of the image forming apparatus 1, the portion of the image forming apparatus 1 excluding the component may be referred to as the main body of the image forming apparatus 1.

The image forming unit 21C includes a photosensitive drum 25 as an electrostatic latent image carrier, a charging roller 26 that uniformly charges a surface of the photosensitive drum 25, a developing roller 28 as a developer carrier that applies cyan toner as developer to an electrostatic latent image formed on the surface of the photosensitive drum 25 to form a toner image, a developing blade 29, and a supply roller 30 pressed against the developing roller 28.

The supply roller 30 supplies cyan toner stored in a final toner storing portion 31C to the developing roller 28. The developing blade 29 is pressed against the developing roller 28. The developing blade 29 forms the toner supplied from the supply roller 30 into a thin layer on the developing roller 28. A cleaning blade 32 is pressed against the surface of the photosensitive drum 25 and scrapes off toner (residual toner) remaining on the photosensitive drum 25 after transfer (described later). The configuration of the image forming unit 21 will be described in more detail later.

Above the photosensitive drum 25 of each of the image forming units 21, an exposure device 27 is disposed to face the photosensitive drum 25. Each of the exposure devices 27 exposes the corresponding photosensitive drum 25 according to image data for the corresponding color to form an electrostatic latent image on the surface of the corresponding photosensitive drum 25.

Each of the transfer rollers 42 of the transfer belt unit 41 is pressed against the corresponding photosensitive drum 25 with the transfer belt 43 therebetween to form a nip portion. The transfer rollers 42 charge the recording sheet to a polarity opposite to that of the toner at the respective nip portions, thereby sequentially transferring toner images of the respective colors formed on the corresponding photosensitive drums 25 onto the recording sheet in a superposed manner.

FIG. 1 shows X, Y, and Z axes. The X axis extends in a direction in which the paper sheet passes through the image forming units 21. The Y axis extends in a direction of rotational axes of the respective photosensitive drums 25 of the image forming units 21. The Z axis extends in a direction perpendicular to both the X and Y axes. The same applies to the other drawings except FIGS. 2, 13A, and 13B. In each of the other drawings, the X, Y, and Z axes indicate the orientation of the part illustrated in the drawing when the part is installed in the image forming apparatus 1. Here, the image forming apparatus 1 is placed so that the Z axis extends in a substantially vertical direction.

Figure 2:
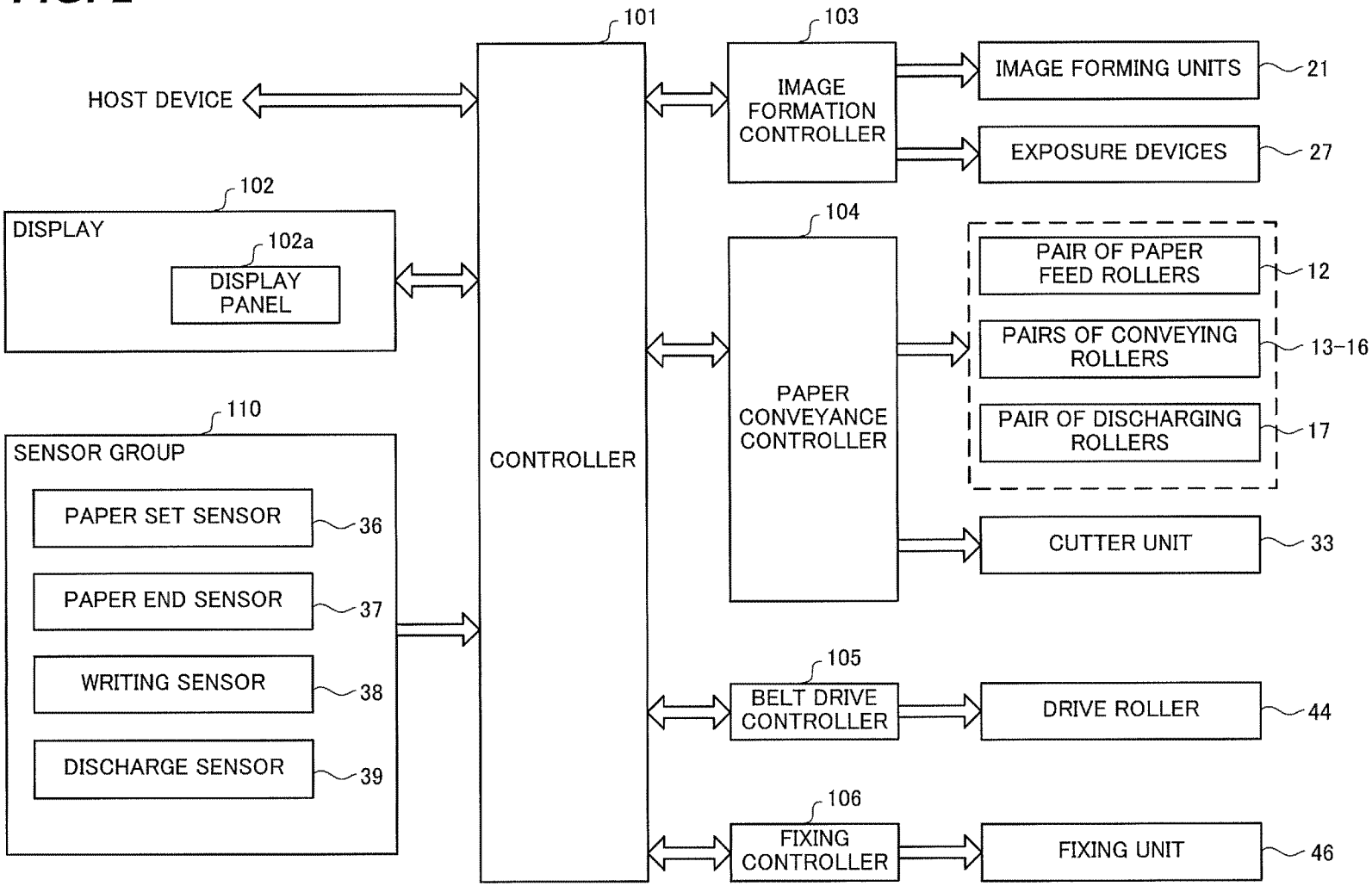
FIG. 2 is a block diagram of a control system of the image forming apparatus.

FIG. 2 is a block diagram of a control system of the image forming apparatus 1.

The control system includes a controller 101, a display 102, a sensor group 110, an image formation controller 103, a belt drive controller 105, a paper conveyance controller 104, and a fixing controller 106.

The controller 101 receives a print command from a host apparatus, notifies the host apparatus or the like of the state of the image forming apparatus 1, and controls all the operations pertaining to printing operation. The display 102 displays data indicating the operation and various settings of the image forming apparatus 1 on a display panel 102*a* in accordance with commands from the controller 101. The sensor group 110 includes the paper set sensor 36, paper end sensor 37, writing sensor 38, discharge sensor 39, and the like. Each sensor of the sensor group 110 sends detection data detected by the sensor to the controller 101.

The image formation controller 103 drives and controls the image forming units 21 and controls emission of light from the exposure devices 27, in accordance with commands from the controller 101. The belt drive controller 105 rotationally drives and controls the drive roller 44 to move the transfer belt 43 (see FIG. 1) in accordance with commands from the controller 101. The paper conveyance controller 104 rotationally drives and controls the pair of paper feed rollers 12, pairs of conveying rollers 13 to 16, and pair of discharging rollers 17 to feed and convey the paper sheet from the paper roll 18 (see FIG. 1), and drives and controls the cutter unit 33 to cut the paper sheet, in accordance with commands from the controller 101. The fixing controller 106 drives and controls the fixing unit 46 to fix the toner image onto the paper sheet in accordance with commands from the controller 101.

The printing operation of the image forming apparatus 1 configured as above will be described with reference to FIGS. 1 and 2.

A paper sheet drawn from the paper roll 18 installed in the paper roll holder 11 is fed by the pair of paper feed rollers 12 from its leading end into the paper conveying path, further conveyed by the pairs of conveying rollers 13 to 16 along the paper conveying path, cut by the cutter unit 33 to a predetermined length, conveyed and placed onto the transfer belt 43, and conveyed to the image forming units 21C, 21M, and 21Y in this order.

Meanwhile, in each of the image forming units 21, the surface of the photosensitive drum 25 is uniformly charged by the charging roller 26 and exposed by the corresponding exposure device 27. At this time, the exposure device 27 illuminates the surface of the photosensitive drum 25 with light whose amount is adjusted based on image data supplied from the host device, thereby forming an electrostatic latent image on the surface. Toner in the thin layer on the developing roller 28 electrostatically adheres to the portion of the photosensitive drum 25 where the electrostatic latent image is formed, thereby forming a toner image of the corresponding color on the photosensitive drum 25. The above operation is started in synchronization with detection of the recording sheet by the writing sensor 38.

The toner images formed on the respective photosensitive drums 25 by the development are sequentially transferred onto the recording sheet by the corresponding transfer rollers 42 to which bias voltages are applied, in a superposed manner, so that a color toner image is formed on the recording sheet. Toner (or residual toner) remaining on the photosensitive drums 25 after the transfer is removed by the cleaning blades 32, and conveyed by a waste toner conveying unit (not illustrated) into waste toner collecting portions 64 (see FIG. 8) described later.

The recording sheet with the color toner image transferred thereon is conveyed to the fixing unit 46. The fixing unit 46 heats and presses the color toner image to fix it to the recording sheet, so that a color image is formed. The recording sheet with the color image formed thereon is discharged by the pair of discharge rollers 17 outside the image forming apparatus 1.

Figure 3:
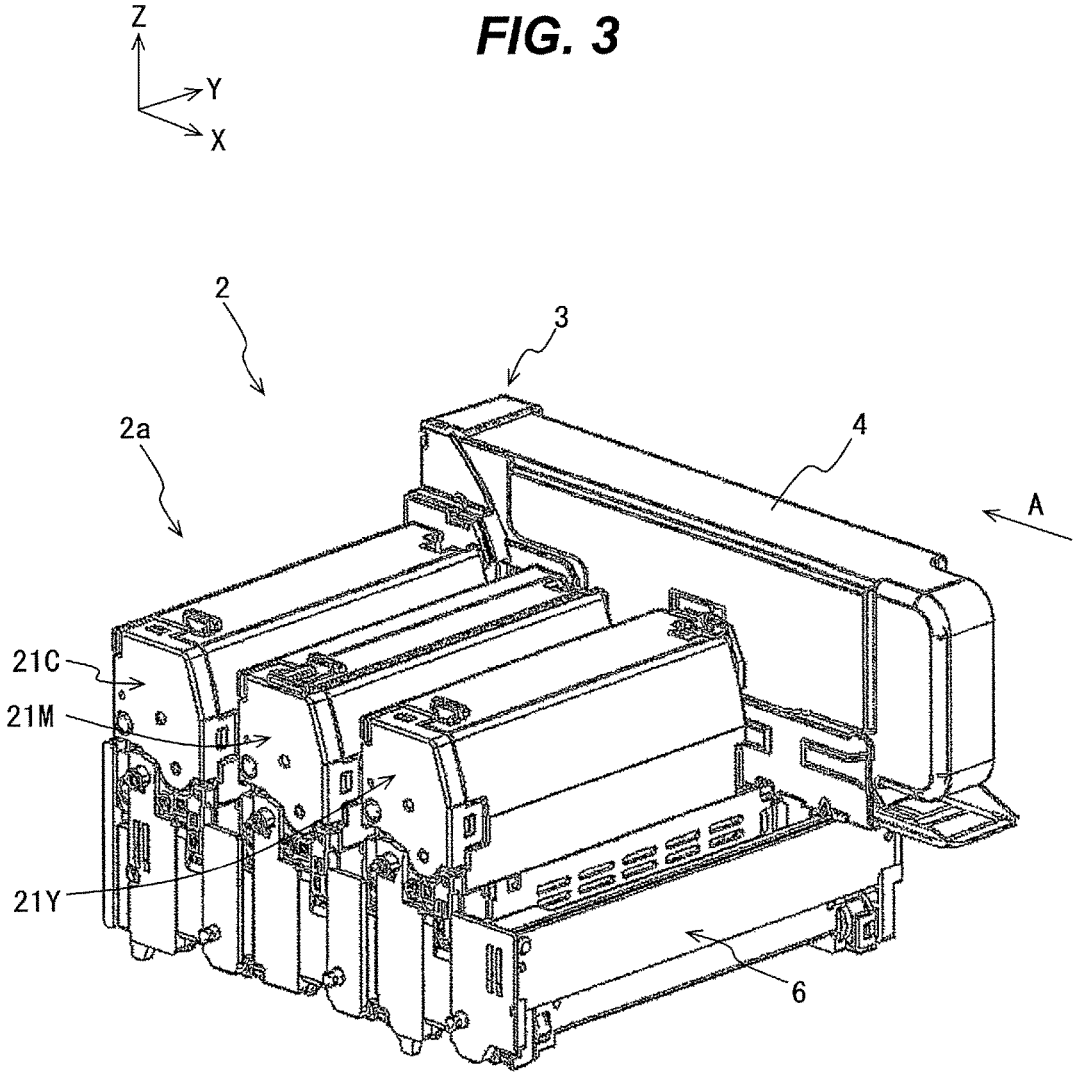
FIG. 3 is an external perspective view of a unit assembly constituting the image forming apparatus.
Figure 4:
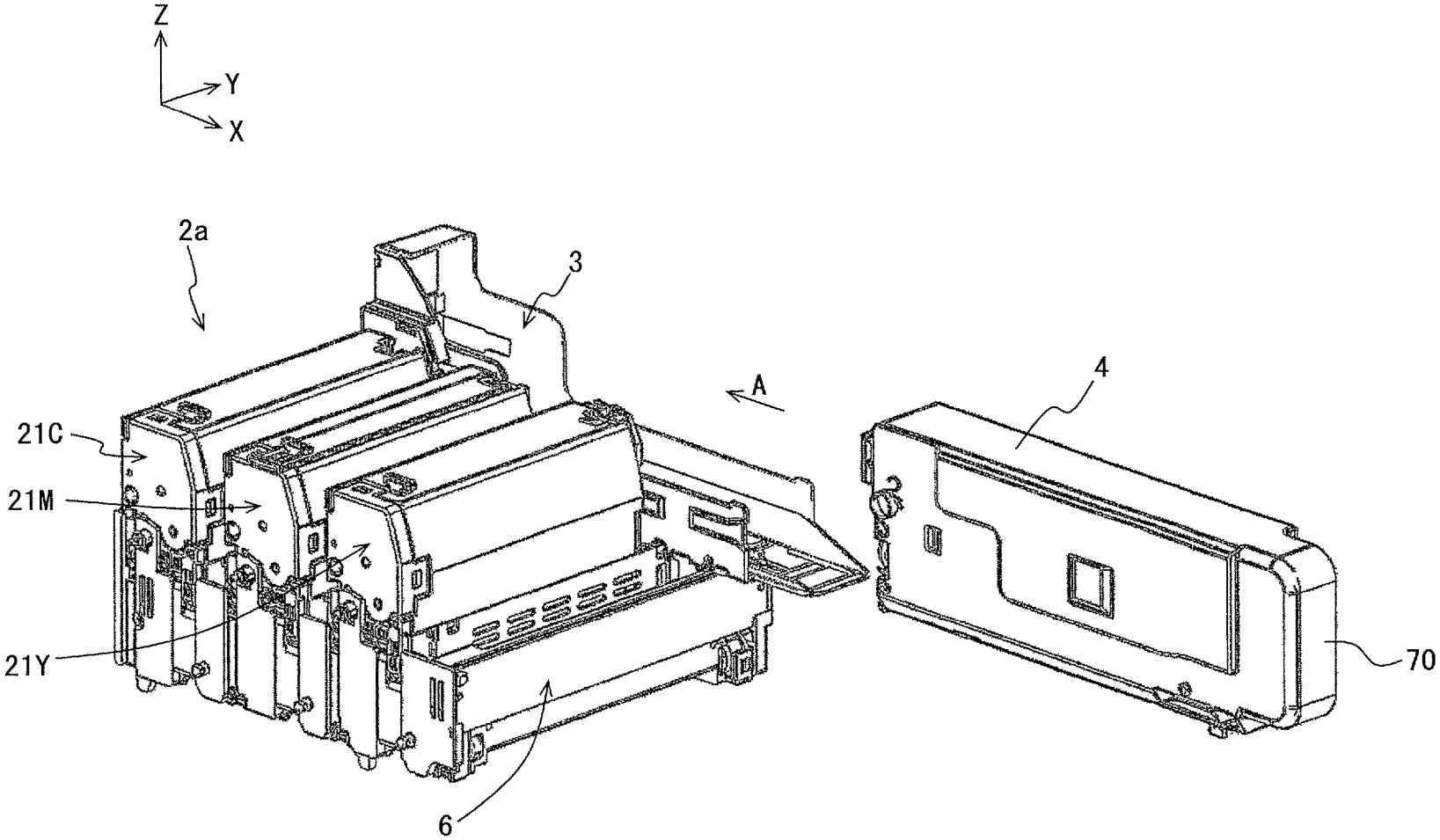
FIG. 4 is an external perspective view of a main body of the unit assembly and a toner cartridge, which is removed from the main body.

FIG. 3 is an external perspective view of a unit assembly 2 of the image forming apparatus 1 of the first embodiment. The unit assembly 2 includes a main body 2*a* and a toner cartridge 4 attached to the main body 2*a*. FIG. 4 is an external perspective view of the main body 2*a* of the unit assembly 2 and the toner cartridge 4, which is removed from the main body 2*a*.

As illustrated in FIGS. 3 and 4, the main body 2*a* includes a basket frame 6 and a holder (or slot) 3 provided on the basket frame 6. The three image forming units 21C, 21M, and 21Y are mounted on the basket frame 6 and integrated with the basket frame 6. The toner cartridge 4 is removably attached to the holder 3. FIG. 3 illustrates a state where the toner cartridge 4 has been attached to the holder 3, and FIG. 4 illustrates a state where the toner cartridge 4 has been removed or drawn from the holder 3.

The unit assembly 2 is placed in the main body of the image forming apparatus 1 so that the respective photosensitive drums 25 of the three image forming units 21C, 21M, and 21Y face the corresponding transfer rollers 42 as illustrated in FIG. 1 and the unit assembly 2 receives rotational driving force for rotary parts of the image forming units 21C, 21M, and 21Y from the main body of the image forming apparatus 1.

Figure 5:
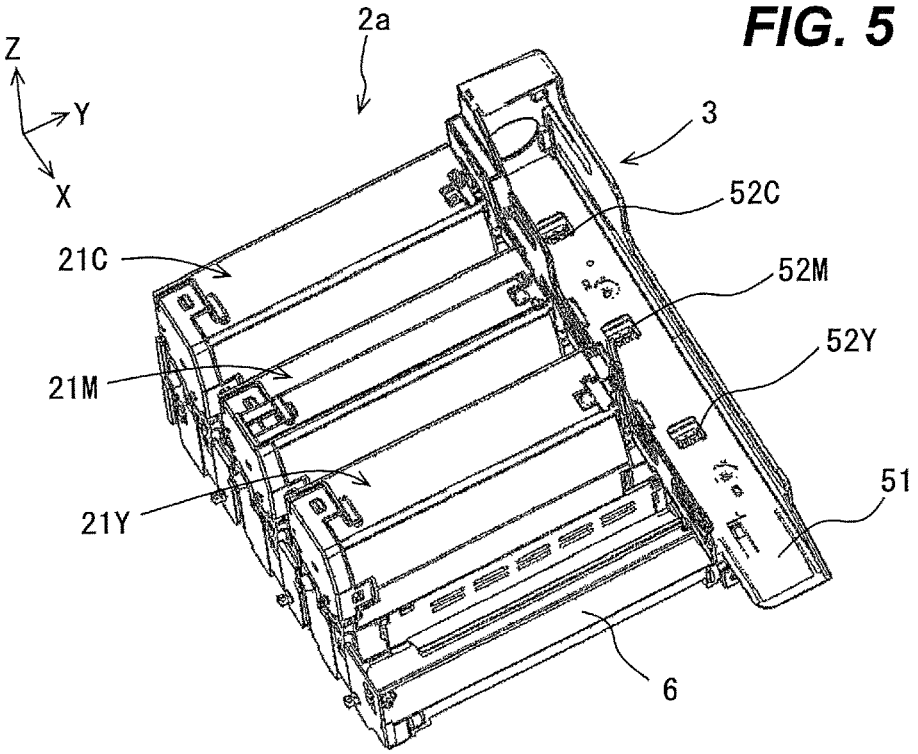
FIG. 5 is an external perspective view of the main body of the unit assembly as viewed from a position from which toner inlets formed in a holder of the main body can be seen.
Figure 6:
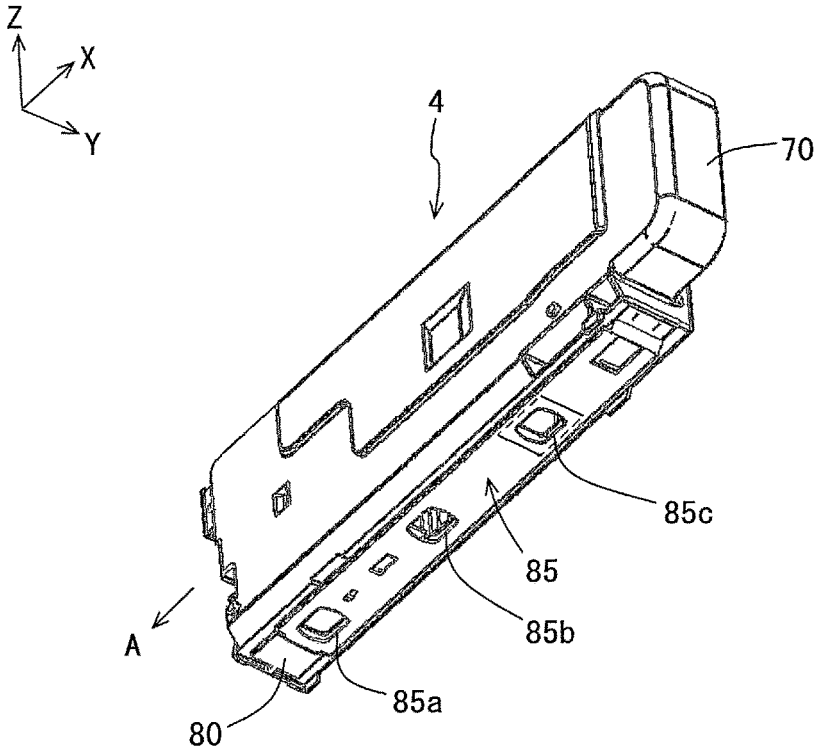
FIG. 6 is an external perspective view of the toner cartridge as viewed obliquely from below.
Figure 7:
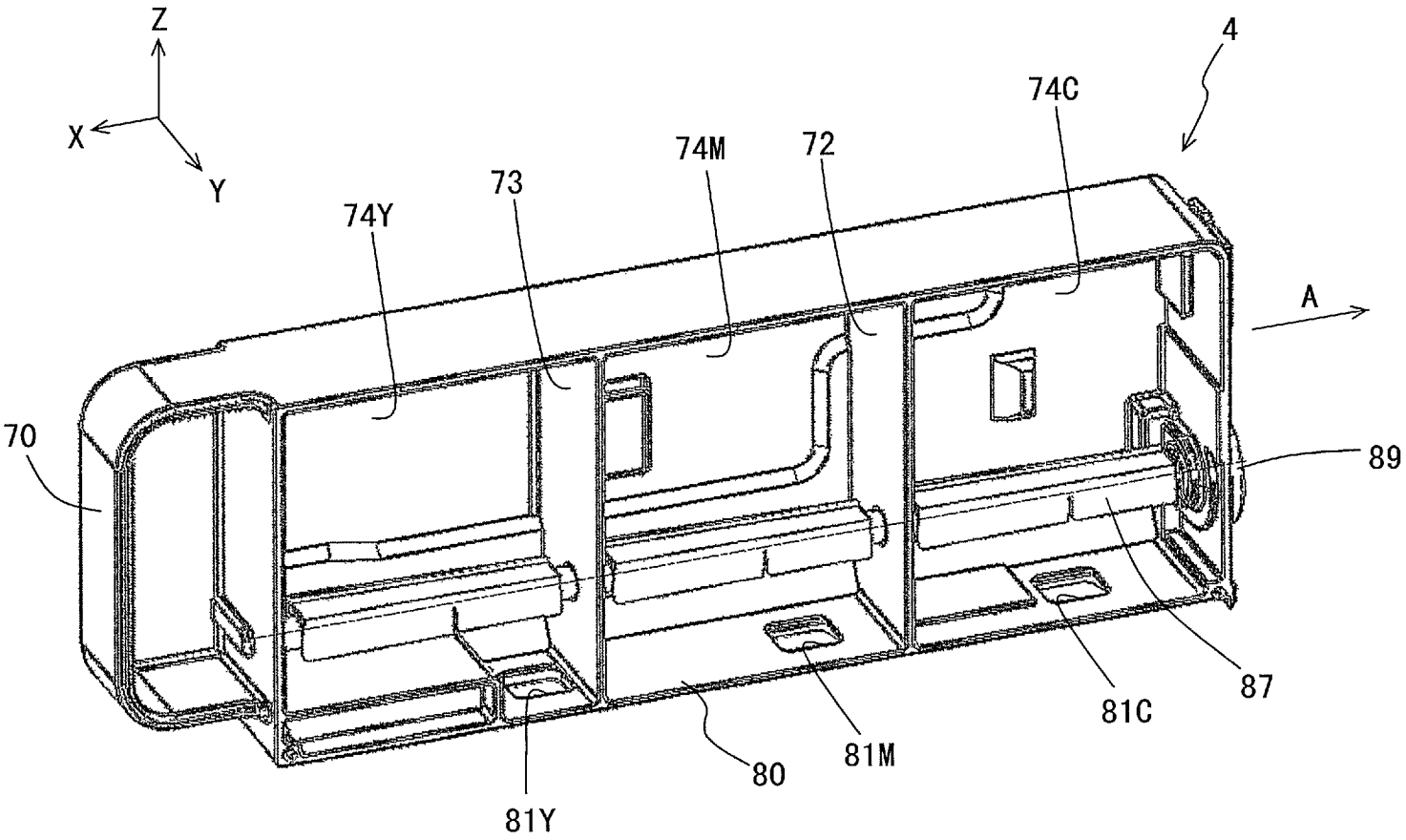
FIG. 7 is a perspective view illustrating the inside of the toner cartridge, wherein an outer wall of the toner cartridge is partially cut away to show the inside of the toner cartridge.

FIG. 5 is an external perspective view of the main body 2*a* of the unit assembly 2. As illustrated in FIG. 5, toner inlets 52C, 52M, and 52Y are formed in the holder 3. FIG. 6 is an external perspective view of the toner cartridge 4 as viewed obliquely from below. FIG. 7 is a perspective view illustrating the inside of the toner cartridge 4. In FIG. 7, an outer wall of the toner cartridge 4 is partially cut away to show the inside of the toner cartridge 4.

In a state where the three image forming units 21C, 21M, and 21Y are mounted on the basket frame 6 and assembled integrally with the holder 3 as illustrated in FIG. 3, the three image forming units 21C, 21M, and 21Y are, for example, aligned in a predetermined direction at predetermined intervals as illustrated in FIG. 1, and the holder 3 is located on holder placing portions of the respective image forming units 21C, 21M, and 21Y in such a manner as to connect the holder placing portions. Each of the holder placing portions is formed on one side (or the right side) of the corresponding image forming unit 21.

In this embodiment, directional terms, such as "front", "rear", "left", and "right", may refer to directions when the unit assembly 2 is viewed from the side from which the paper sheet is discharged (or viewed in the direction of arrow A).

The holder 3 is disposed so that its longitudinal direction (the X axis direction), which is an insertion/removal direction (described later) of the toner cartridge 4, coincides with the direction in which the three image forming units 21C, 21M, and 21Y are arranged. The holder 3 includes a bottom portion 51 with the toner inlets 52C, 52M, and 52Y formed therein, as illustrated in FIG. 5. The toner inlet 52C overlaps an opening (not illustrated) formed in the holder placing portion of the image forming unit 21C and communicates with the final toner storing portion 31C (see FIG. 1) of the image forming unit 21C. The toner inlet 52M overlaps an opening (not illustrated) formed in the holder placing portion of the image forming unit 21M and communicates with a final toner storing portion 31M (see FIG. 1) of the image forming unit 21M. The toner inlet 52Y overlaps an opening (not illustrated) formed in the holder placing portion of the image forming unit 21Y and communicates with a final toner storing portion 31Y (see FIG. 1) of the image forming unit 21Y. These configurations will be further described later. When the final toner storing portions 31C, 31M, and 31Y need not be distinguished from each other, they will be referred to as the final toner storing portions 31.

As illustrated in FIGS. 6 and 7, the toner cartridge 4 has a substantially rectangular parallelepiped shape. The inside of the toner cartridge 4 is separated by partitions 72 and 73 (see FIG. 7) into three cartridge toner storing portions: a cartridge toner storing portion 74C that stores cyan (C) toner, a cartridge toner storing portion 74M that stores magenta (M) toner, and a cartridge toner storing portion 74Y that stores yellow (Y) toner. When the cartridge toner storing portions 74C, 74M, and 74Y need not be distinguished from each other, they will be referred to as the cartridge toner storing portions 74.

A handle 70 is formed at a front end portion of the toner cartridge 4. The handle 70 is grasped mainly when the toner cartridge 4 is inserted into or removed from the holder 3 (see FIG. 4). The toner cartridge 4 includes a bottom portion 80 in which three toner outlets 81C, 81M, and 81Y are formed. The toner outlets 81C, 81M, and 81Y are respectively located at bottoms of the three cartridge toner storing portions 74C, 74M, and 74Y.

These toner outlets 81C, 81M, and 81Y are configured so that they can be opened and closed by an opening/closing shutter 85 (see FIG. 6), which is slidably held on the bottom portion 80. The opening/closing shutter 85 is a plate-like member having three openings 85*a*, 85*b*, and 85*c*, and extends in a longitudinal direction (or the direction in which the three cartridge toner storing portions 74 are adjacent) of the toner cartridge 4. The opening/closing shutter 85 is held slidably in the longitudinal direction of the toner cartridge 4 by one or more holding members (not illustrated).

The opening/closing shutter 85 is urged by an urging member or unit (not illustrated) in the direction of arrow A, which is an insertion direction of the toner cartridge 4. When the opening/closing shutter 85 is subjected to no force other than the urging force of the urging member, it closes the toner outlets 81C, 81M, and 81Y of the toner cartridge 4 and keeps them in a closed state. When the toner cartridge 4 is installed into the holder 3, the opening/closing shutter 85 slides with the installation, and the openings 85*a*, 85*b*, and 85*c* of the opening/closing shutter 85 respectively overlap and open the toner outlets 81C, 81M, and 81Y of the toner cartridge 4, thereby putting them into an open state.

As illustrated in FIG. 7, the toner cartridge 4 further includes an agitating shaft 87 rotatably supported and extending in the longitudinal direction of the toner cartridge 4 through the three toner storing portions 74C, 74M, and 74Y. The agitating shaft 87 includes a passive gear 89 at its tip portion in the insertion direction (or the direction of arrow A) of the toner cartridge 4. When the toner cartridge 4 is attached to the holder 3, the passive gear 93 meshes with a drive gear (not illustrated) disposed on the holder 3 side and receives driving force from the drive gear to rotate.

Figure 8A:
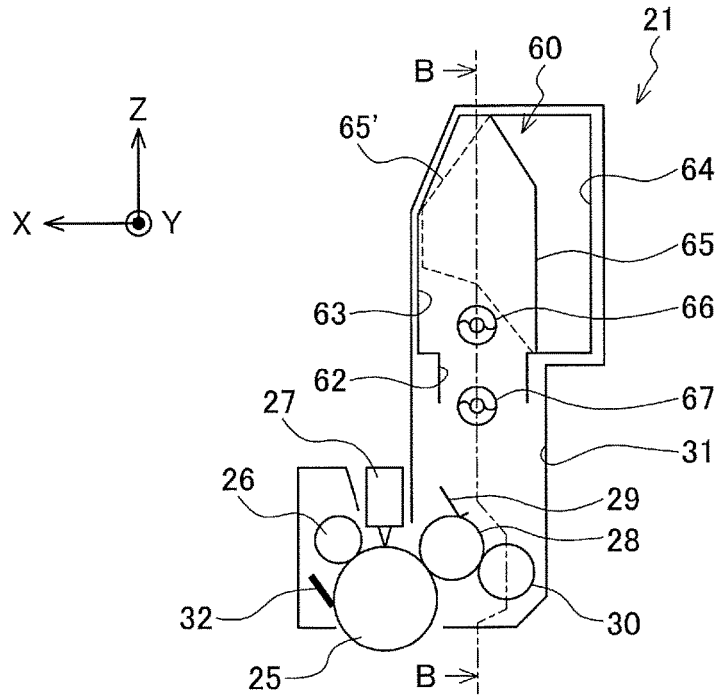
FIGS. 8A and 8B are configuration diagrams schematically illustrating a spatial connection between an image forming unit and a cartridge toner storing portion of a toner cartridge corresponding to the image forming unit, FIG. 8A being a configuration diagram of the main components of the image forming unit as viewed from a positive Y side (or front side), FIG. 8B being a sectional view taken along line B-B in FIG. 8A.
Figure 8B:
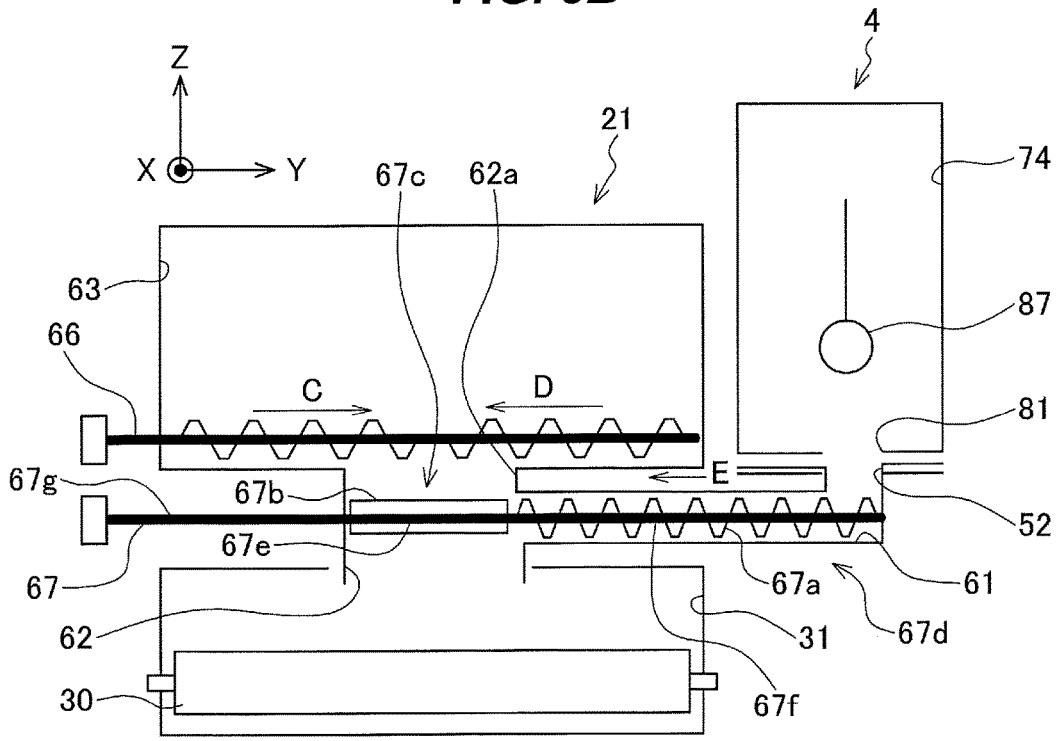

FIGS. 8A and 8B are configuration diagrams of an image forming unit 21 and the toner cartridge 4 corresponding to the image forming unit 21. FIGS. 8A and 8B schematically illustrate a spatial connection between the image forming unit 21 and the cartridge toner storing portion 74 of the toner cartridge 4. FIG. 8A is a configuration diagram of the main components of the image forming unit 21 as viewed from the positive Y side (or front side). FIG. 8B is a sectional view taken along line B-B in FIG. 8A. FIG. 8B illustrates the main components of the toner cartridge 4, which are omitted in FIG. 8A.

As illustrated in FIG. 8A, the charging roller 26, exposure device 27, and developing roller 28 are disposed around the photosensitive drum 25 of the image forming unit 21. The supply roller 30, which applies toner to the developing roller 28, and the developing blade 29, which regulates the thickness of the toner on the developing roller 28, are disposed in contact with the developing roller 28. The photosensitive drum 25, charging roller 26, developing roller 28, developing blade 29, and supply roller 30 constitute a toner image forming unit.

A unit toner storing portion 60 as a toner storing portion that stores toner is formed in an upper portion of the image forming unit 21. The unit toner storing portion 60 is divided by a movable partition 65 into the waste toner collecting portion 64 as a waste toner storing portion and a supply toner storing portion 63 as a first supply toner storing portion that communicates with the final toner storing portion 31.

A toner supply path (or toner collection/supply path) 62 is formed between the final toner storing portion 31, which is a space above the supply roller 30, and the supply toner storing portion 63, which is located above the final toner storing portion 31. In a longitudinal direction (or the Y axis direction) of the image forming unit 21, the toner supply path 62 is narrowed toward a center of the image forming unit 21. A toner conveying path 61 as a second supply portion is connected to a side of a middle portion of the toner supply path 62. The toner conveying path 61 extends in the longitudinal direction (or the Y axis direction) of the image forming unit 21 and communicates with the toner inlet 52 of the holder 3 through the opening of the holder placing portion.

A second toner supply spiral 66 as a second conveying member or unit is disposed in a lower portion of the supply toner storing portion 63, and extends in a longitudinal direction (or the Y axis direction) of the supply toner storing portion 63. The second toner supply spiral 66 conveys the toner in the supply toner storing portion 63 toward a central portion of the supply toner storing portion 63. Specifically, the second toner supply spiral 66 conveys the toner stored in the supply toner storing portion 63 toward an opening 62*a* as a first supply portion of the toner supply path 62 (or in the directions of arrows C and D in FIG. 8B). Further, a first toner supply spiral 67 as a first conveying member or unit is disposed through the toner supply path 62 and toner conveying path 61, and extends in its longitudinal direction (or the Y axis direction).

One or more paddles 67*b* are formed on the first toner supply spiral 67 in a region to which the toner in the supply toner storing portion 63 falls through the opening 62*a*. The paddles 67*b* agitate the toner in the toner supply path 62 and mainly urge the toner supplied from the supply toner storing portion 63 to fall into the final toner storing portion 31. Further, a spiral 67*a* is formed on the first toner supply spiral 67 in a region extending through the entire toner conveying path 61 and overlapping the toner supply path 62. The spiral 67*a* conveys the toner supplied from the cartridge toner storing portion 74 toward the toner supply path 62 (in the direction of arrow E in FIG. 8B).

Specifically, the first toner supply spiral 67 includes a first conveying portion 67*c* that conveys the toner supplied from the supply toner storing portion 63, and a second conveying portion 67*d* that conveys the toner supplied from the cartridge toner storing portion 74. The first conveying portion 67*c* includes a first rotation shaft 67*e* and the one or more paddles 67*b* formed on the first rotation shaft 67*e*. The second conveying portion 67*d* includes a second rotation shaft 67*f* connected to the first rotation shaft 67*e*, and the spiral 67*a* formed on the second rotation shaft 67*f*. The first conveying portion 67*c* may also convey the toner supplied from the cartridge toner storing portion 74. The first conveying portion 67*c* may convey mainly the toner supplied from the supply toner storing portion 63. The toner supplied from the supply toner storing portion 63 is conveyed mainly by the first conveying portion 67*c*. The first rotation shaft 67*e* and second rotation shaft 67*f* constitute a rotation shaft 67*g* of the first toner supply spiral 67.

The movable partition 65 is flexible and deformable as indicated by the dashed line 65' in FIG. 8A. The first toner supply spiral 67 and second toner supply spiral 66 are driven by a drive unit (not illustrated).

Next, movement of the toners supplied from the supply toner storing portion 63 as the first supply toner storing portion and the cartridge toner storing portion 74 as the second supply toner storing portion into the final toner storing portion 31 during printing operation.

FIGS. 9A, 9B, 10A, 10B, 11A, 11B, 12A, and 12B are state explanation diagrams schematically illustrating the spatial connection between the image forming unit 21 and the cartridge toner storing portion 74 of the toner cartridge 4 corresponding to the image forming unit 21 similarly to FIGS. 8A and 8B, and additionally illustrating movement of the toners stored in the supply toner storing portion 63 and cartridge toner storing portion 74.

Figure 9A:
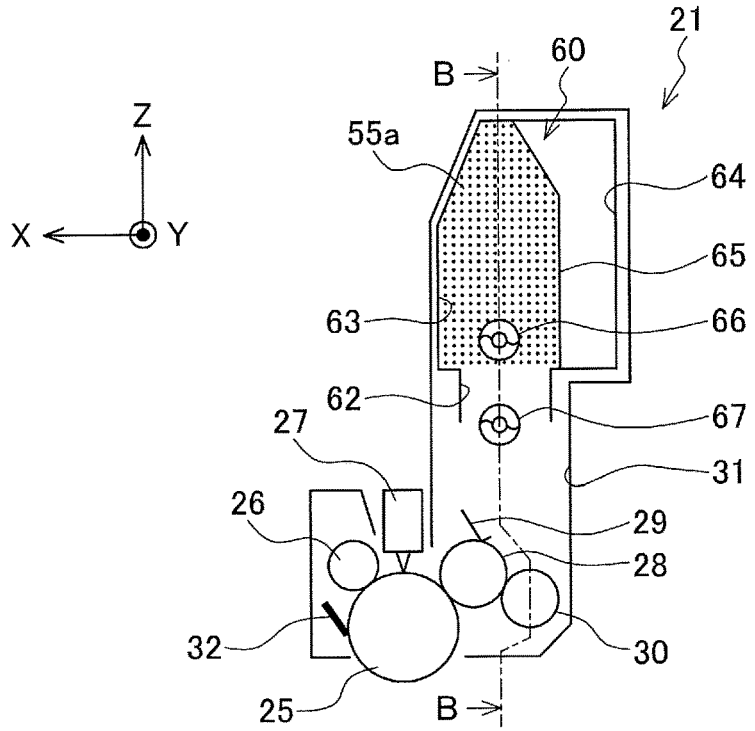
FIGS. 9A and 9B are state explanation diagrams schematically illustrating the spatial connection between the image forming unit and the cartridge toner storing portion of the toner cartridge corresponding to the image forming unit similarly to FIGS. 8A and 8B, and additionally illustrating toners stored in a supply toner storing portion of the image forming unit and the cartridge toner storing portion, FIGS. 9A and 9B illustrating a state where the supply toner storing portion of the image forming unit and the cartridge toner storing portion of the toner cartridge are filled with the toners before the toners are supplied.
Figure 9B:
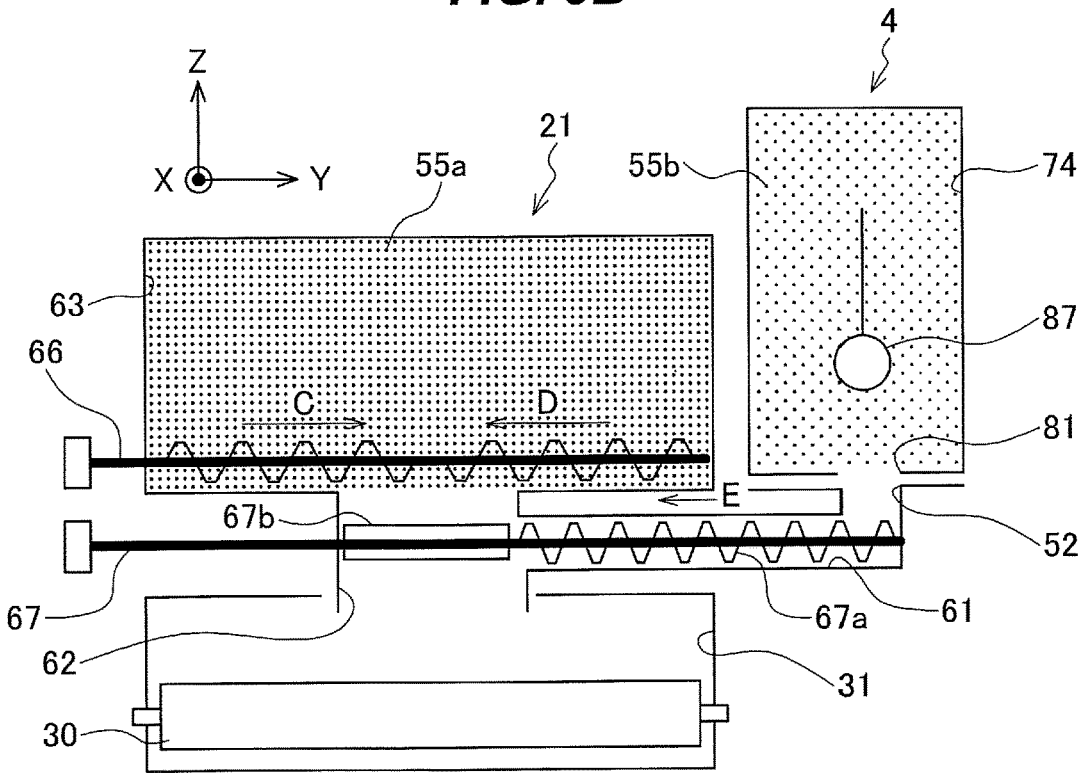

FIGS. 9A and 9B illustrate a state where the supply toner storing portion 63 of the image forming unit 21 is filled with a toner 55*a* as a first supply toner and the cartridge toner storing portion 74 of the toner cartridge 4 is filled with a toner 55*b* as a second supply toner before the toners 55*a* and 55*b* are supplied. Although the toner 55*a* stored in the supply toner storing portion 63 and the toner 55*b* stored in the cartridge toner storing portion 74 are exactly (or substantially) the same, they are distinguished from each other using the different reference characters for the sake of convenience.

When a printing operation starts, the image forming unit 21 starts to be driven, and the first toner supply spiral 67 and second toner supply spiral 66 start to rotate, thereby conveying both the toner 55*a* in the supply toner storing portion 63 and the toner 55*b* in the cartridge toner storing portion 74 to the toner supply path 62.

Figure 10A:
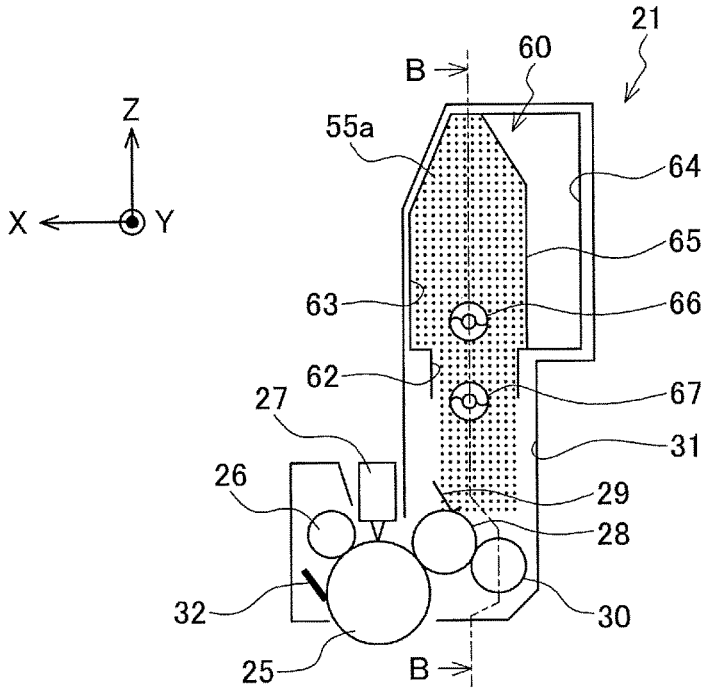
FIGS. 10A and 10B are state explanation diagrams similar to FIGS. 9A and 9B, and illustrate a state where the amount of toner supplied from the supply toner storing portion is greater than the amount of toner supplied from the cartridge toner storing portion.
Figure 10B:
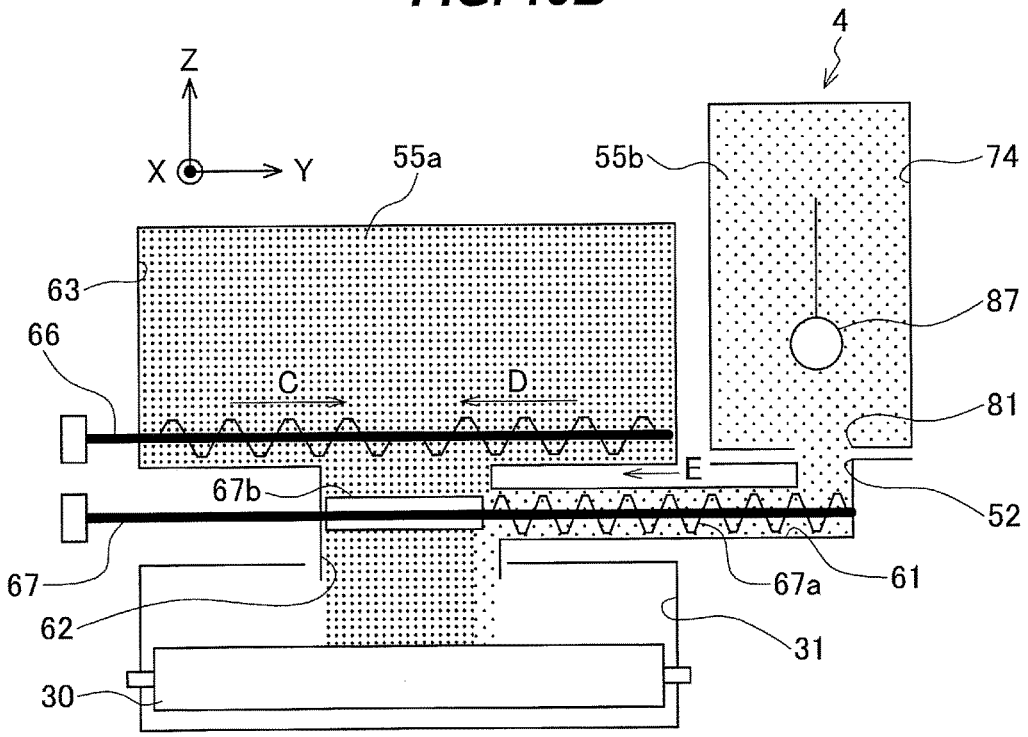

Here, the image forming unit 21 is configured so that in the toner supply path 62, the amount of the toner 55*a*, which is supplied from the supply toner storing portion 63, conveyed (per unit time) is greater than the amount of the toner 55*b*, which is supplied from the cartridge toner storing portion 74, conveyed (per unit time). Thus, as illustrated in FIGS. 10A and 10B, the amount of the toner 55*a* supplied from the supply toner storing portion 63 into the final toner storing portion 31 through the toner supply path 62 (per unit time) is greater than the amount of the toner 55*b* supplied from the cartridge toner storing portion 74 into the final toner storing portion 31 through the toner supply path 62 (per unit time).

Figure 13A:
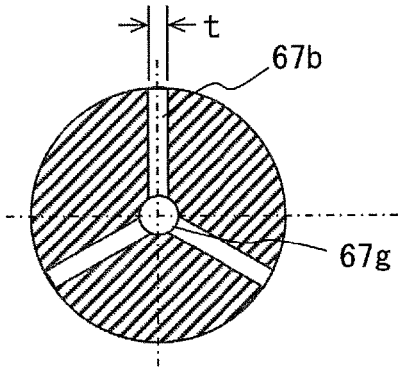
FIGS. 13A to 13D are diagrams illustrating dimensions of a first toner supply spiral, FIGS. 13A and 13B being sectional views of the first toner supply spiral in a region in which one or more paddles are formed, as viewed from the side and front, respectively, FIGS. 13C and 13D being sectional views of the first toner supply spiral in a region in which a spiral is formed, as viewed from the side and front, respectively.
Figure 13B:
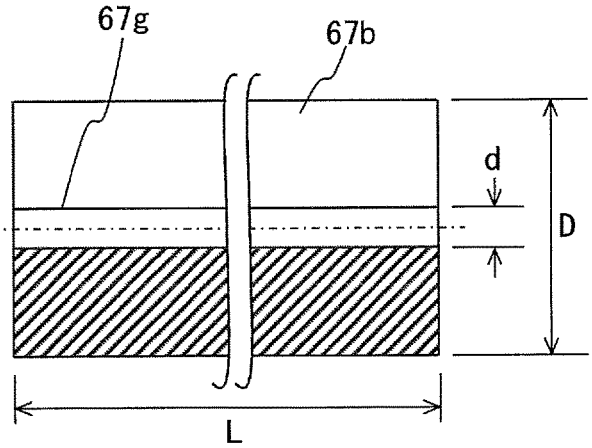
Figure 13C:
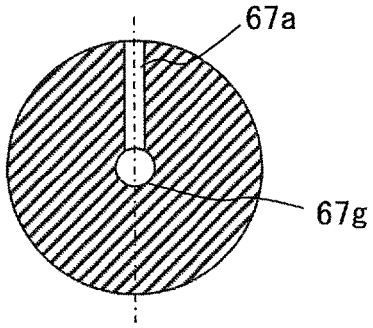
Figure 13D:
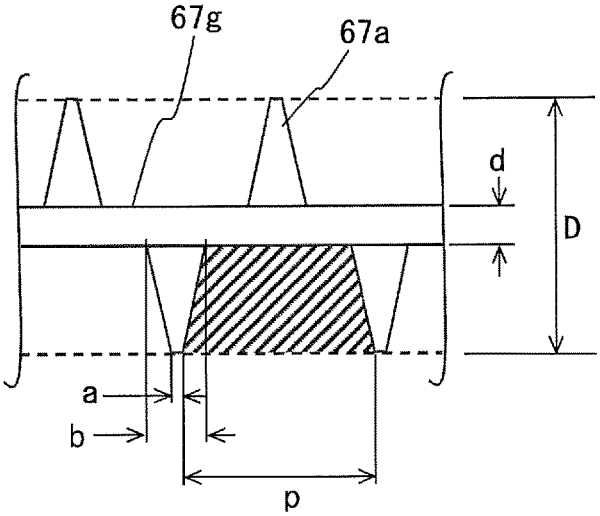

The way employed in this embodiment to make the supply of the toner 55*a* greater than the supply of the toner 55*b* will be described with reference to FIGS. 13A to 13D. FIGS. 13A to 13D illustrate dimensions of the first toner supply spiral 67. FIGS. 13A and 13B are sectional views of the first toner supply spiral 67 in the region in which the paddles 67*b* are formed, as viewed from the side and front, respectively. FIGS. 13C and 13D are sectional views of the first toner supply spiral 67 in the region in which the spiral 67*a* is formed, as viewed from the side and front, respectively.

As illustrated in FIGS. 8A and 8B, the paddles 67*b* are formed across substantially the entire width of the opening 62*a* of the toner supply path 62 in a longitudinal direction (or the Y axis direction) of the opening 62*a*. Thus, most of the toner conveyed by the paddles 67*b* is the toner 55*a* supplied from the supply toner storing portion 63. The toner conveyed by the spiral 67*a*, which is disposed in the toner conveying path 61, is the toner 55*b* supplied from the cartridge toner storing portion 74.

The amount V1 of toner conveyed by the paddles 67*b* during one revolution of the first toner supply spiral 67 and the amount V2 of toner conveyed by the spiral 67*a* during one revolution of the first toner supply spiral 67 will now be described.

When it is assumed that the first toner supply spiral 67 has an outer diameter D, the rotation shaft 67*g* of the first toner supply spiral 67 has a diameter d, the paddles 67*b* each have a thickness t, the first toner supply spiral 67 has n paddles 67*b*, the paddles 67*b* each have a length L, a tip of the spiral 67*a* has a thickness a, a base of the spiral 67*a* has a thickness b, the spiral 67*a* has a pitch p, as illustrated in FIGS. 13A to 13D, the amount V1 of toner conveyed per one revolution is given by the following equation (1):

$$V1=\{(D^2-d^2)\cdot\pi/4-n\cdot t\cdot(D-d)/2\}\cdot L, \quad (1)$$

and the amount V2 of toner conveyed per one revolution is given by the following equation (2):

$$V2=\{(D^2-d^2)\cdot\pi/4\}\cdot\{p-(a+b)/2\}. \quad (2)$$

In this embodiment, D=10 mm, d=4 mm, t=1 mm, n=3, L=40 mm, a=1 mm, b=2 mm, and p=10 mm. Substituting these specific values into equations (1) and (2) yields V1=2278.9 $mm^2$, V2=560.8 $mm^2$, and V1>V2. In this case, the amount of the toner 55*a* supplied from the supply toner storing portion 63 (per unit time) is greater than the amount of the toner 55*b* supplied from the cartridge toner storing portion 74 (per unit time).

Figure 11A:
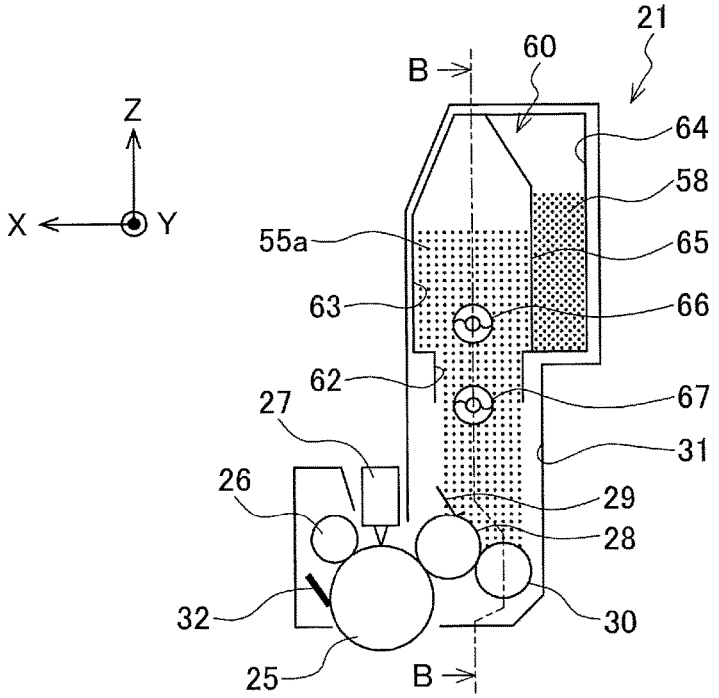
FIGS. 11A and 11B are state explanation diagrams similar to FIGS. 9A and 9B, and illustrate a state where some toner still remains in the supply toner storing portion and thus a movable partition has not yet deformed.
Figure 11B:
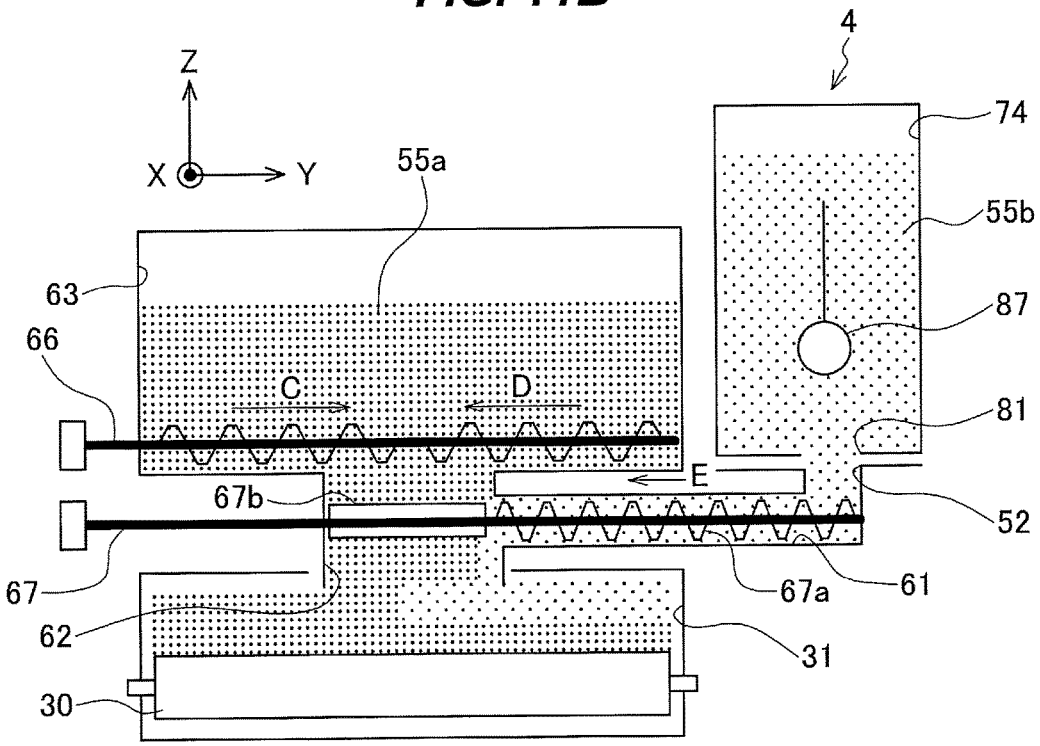
Figure 12A:
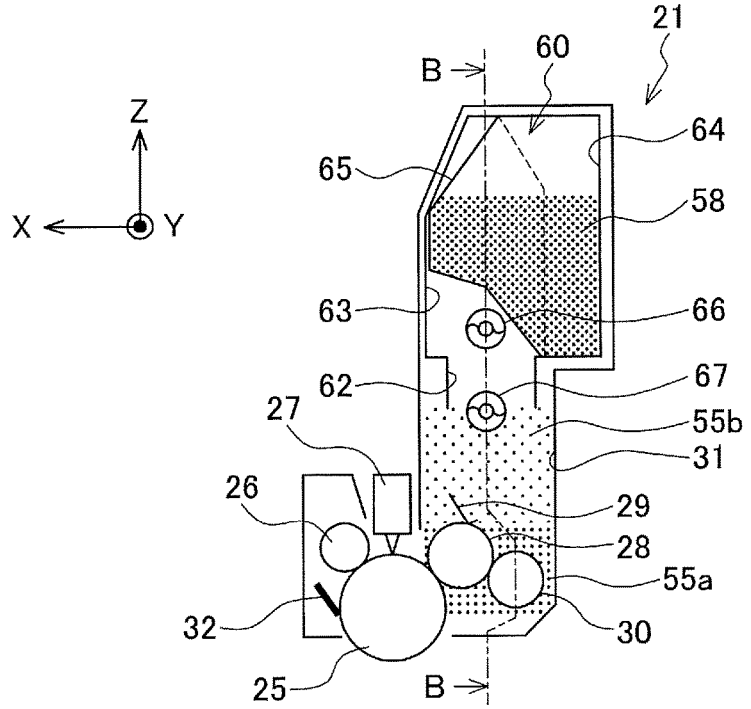
FIGS. 12A and 12B are state explanation diagrams similar to FIGS. 9A and 9B, and illustrate a state where the movable partition has deformed from the position indicated by the dashed line to the position indicated by the solid line and the capacity of a waste toner collecting portion has increased.
Figure 12B:
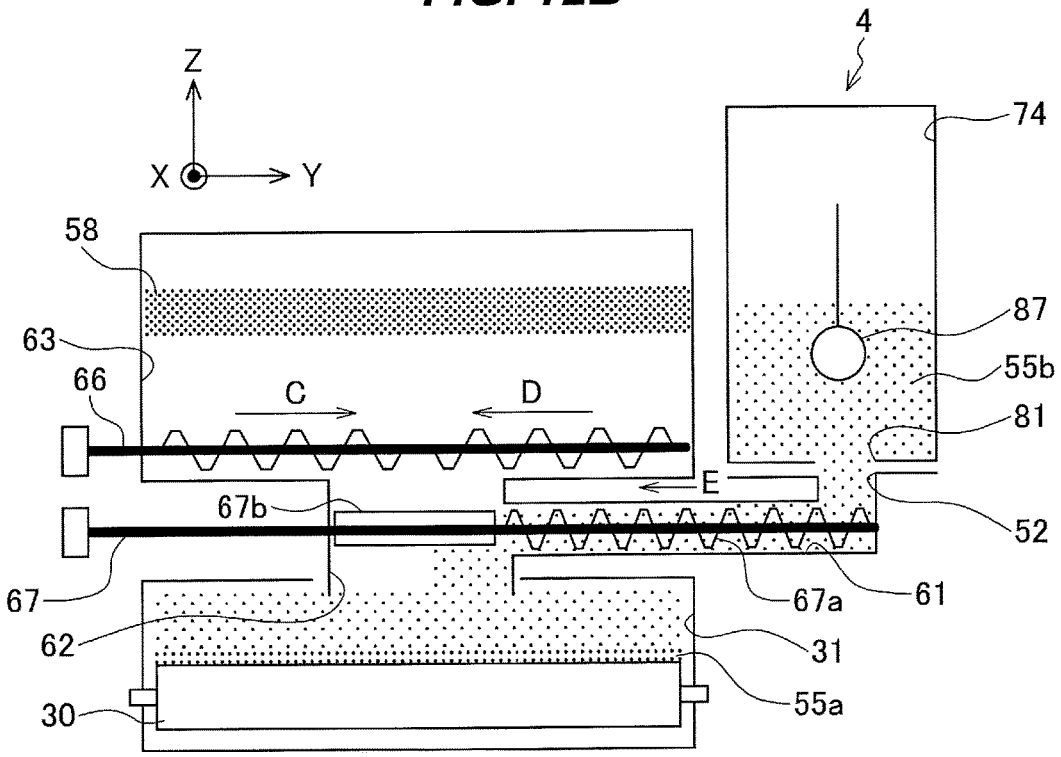

As the amount of toner supplied into the final toner storing portion 31 increases, the amount of waste toner 58 collected in the waste toner collecting portion 64 gradually increases, as illustrated in FIGS. 11A and 11B. The waste toner 58 is, for example, toner (residual toner) that has remained on the photosensitive drum 25, illustrated in FIG. 1, after the transfer, scraped off by the cleaning blade 32, and conveyed by the waste toner conveying unit (not illustrated) into the waste toner collecting portion 64.

At the stage illustrated in FIGS. 11A and 11B, some of the toner 55*a* still remains in the supply toner storing portion 63, and the movable partition 65 has not yet deformed. When the supply of the toner 55*a* from the supply toner storing portion 63 further continues, the supply toner storing portion 63 becomes empty in due course, and accordingly, the amount of the toner 55*b* supplied from the cartridge toner storing portion 74 into the final toner storing portion 31 increases. Thus, the amount of the waste toner collected in the waste toner collecting portion 64 continues to increase. However, since the supply toner storing portion 63 has become empty, the movable partition 65 is pushed by the waste toner 58 and deforms from the position indicated by the dashed line in FIG. 12A to the position indicated by the solid line in FIG. 12A, thereby increasing the capacity or volume of the waste toner collecting portion 64.

Thus, even when the toner 55*a* in the supply toner storing portion 63 has run out, since the toner 55*b* continues to be supplied from the cartridge toner storing portion 74, the printing process can be continued until the waste toner collecting portion 64 is maximized and filled with the waste toner 58. During this process, when the toner 55*b* in the cartridge toner storing portion 74 runs out, the printing process can be continued by replacing the toner cartridge 4.

The above description regarding the image forming unit 21 and the cartridge toner storing portion 74 of the toner cartridge 4 corresponding thereto applies to the three image forming units 21C, 21M, and 21Y and the three cartridge toner storing portions 74C, 74M, and 74Y corresponding thereto.

As described above, in the image forming apparatus of this embodiment, a replaceable toner cartridge 4 including the cartridge toner storing portions 74 in an integrated manner is provided in addition to the supply toner storing portions 63 provided in the respective image forming units 21. This makes it possible to decrease the frequency of replacement of the toner cartridge and improve the usability. Further, it is possible to efficiently ensure the space for collecting the waste toner, and use space efficiently. This makes it possible to downsize the apparatus.

Further, the capacity of the waste toner collecting portion 64 provided in the unit toner storing portion 60 increases as the amount of waste toner stored in the waste toner collecting portion 64 increases. This can prevent a situation where before the image forming unit 21 is worn out, the waste toner collecting portion 64 is filled with the waste toner and the image forming unit 21 needs to be replaced.

Further, the capacity of the waste toner collecting portion 64 is increased. This allows space to be used effectively, and can reduce the frequency of replacement of the image forming unit 21 including the waste toner collecting portion 64.

Further, toner is supplied not only from the supply toner storing portion 63 of the unit toner storing portion 60 but also from the cartridge toner storing portion 74 of the toner cartridge 4. This can prevent a situation where the supply of toner becomes impossible before the waste toner collecting portion 64 is filled with the waste toner.

Further, the image forming apparatus 1 is configured so that the toner 55*a* in the supply toner storing portion 63 runs out earlier than the toner 55*b* in the cartridge toner storing portion 74. For example, the image forming apparatus 1 is configured so that the amount of the toner 55*a* supplied from the supply toner storing portion 63 (per unit time) is greater than the amount of the toner 55*b* supplied from the cartridge toner storing portion 74 (per unit time). This can prevent a situation where before the waste toner collecting portion 64 reaches its maximum capacity, the waste toner collecting portion 64 is filled with the waste toner and the image forming unit 21 needs to be replaced.

Second Embodiment

An image forming apparatus according to a second embodiment of the present invention will now be described. The image forming apparatus of the second embodiment is substantially the same as the image forming apparatus 1 of the first embodiment except that it employs image forming units 221 instead of the image forming units 21. The image forming units 221 are substantially the same as the image forming units 21 except that they each employ a first toner supply spiral 267 instead of the first toner supply spiral 67. Parts that are the same as or correspond to those of the first embodiment will be given the same reference characters, and descriptions thereof will be omitted.

Figure 14A:
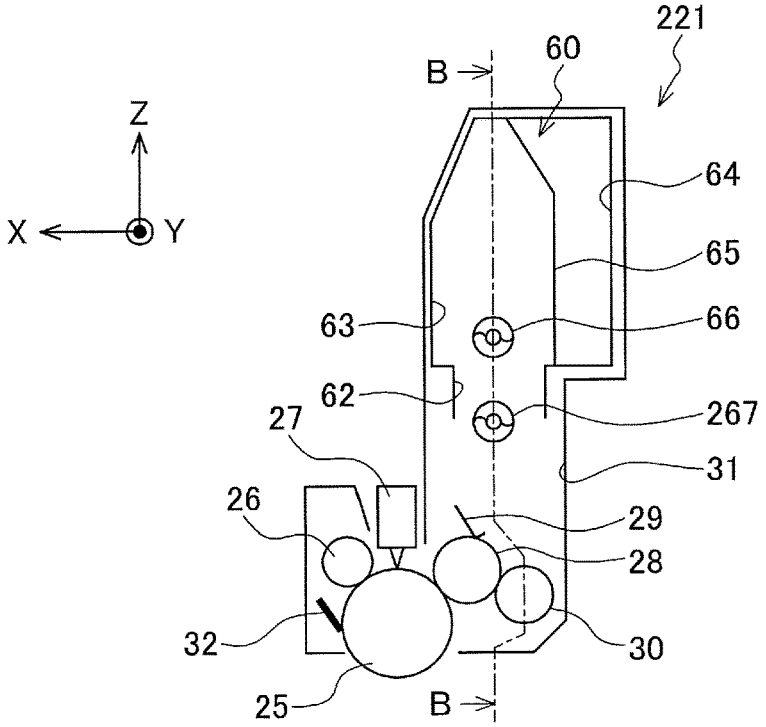
FIGS. 14A and 14B are configuration diagrams schematically illustrating a spatial connection between an image forming unit and a cartridge toner storing portion of a toner cartridge corresponding to the image forming unit in a second embodiment, FIG. 14A being a configuration diagram of the main components of the image forming unit as viewed from the positive Y side (or front side), FIG. 14B being a sectional view taken along line B-B in FIG. 14A.
Figure 14B:
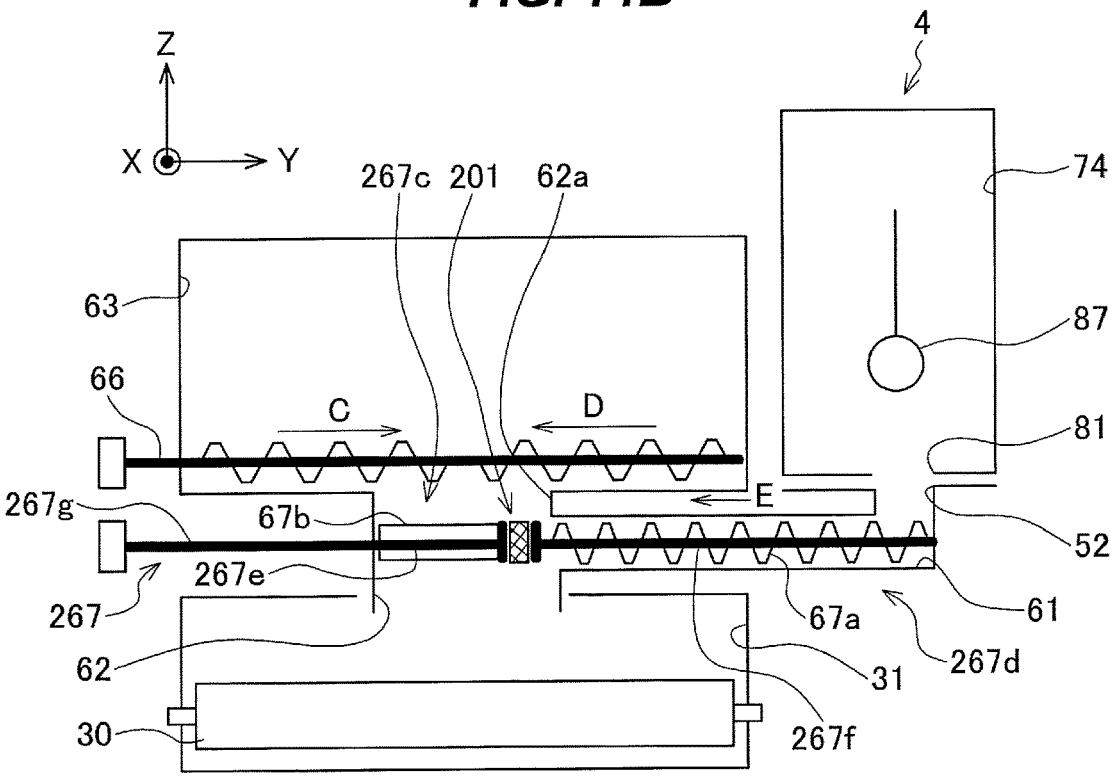

FIGS. 14A and 14B are configuration diagrams of an image forming unit 221 and the toner cartridge 4 corresponding to the image forming unit 221. FIGS. 14A and 14B schematically illustrate a spatial connection between the image forming unit 221 and the cartridge toner storing portion 74 of the toner cartridge 4. FIG. 14A is a configuration diagram of the main components of the image forming unit 221 as viewed from the positive Y side (or front side). FIG. 14B is a sectional view taken along line B-B in FIG. 14A. FIG. 14B illustrates the main components of the toner cartridge 4, which are omitted in FIG. 14A.

As illustrated in FIG. 14B, the first toner supply spiral 267 includes a torque clutch 201 disposed between a rotation shaft 267*e* as a first rotation shaft and a rotation shaft 267*f* as a second rotation shaft, at a boundary between the region in which the one or more paddles 67*b* are formed and the region in which the spiral 67*a* is formed.

Specifically, the first toner supply spiral 267 includes a first conveying portion 267*c* that conveys the toner supplied from the supply toner storing portion 63, and a second conveying portion 267*d* that conveys the toner supplied from the cartridge toner storing portion 74. The first conveying portion 267*c* includes the first rotation shaft 267*e* and the one or more paddles 67*b* formed on the first rotation shaft 267*e*. The second conveying portion 267*d* includes the second rotation shaft 267*f* connected to the first rotation shaft 267*e* through the torque clutch 201, and the spiral 67*a* formed on the second rotation shaft 267*f*. The first conveying portion 267*c* may also convey the toner supplied from the cartridge toner storing portion 74. The first conveying portion 267*c* may convey mainly the toner supplied from the supply toner storing portion 63. The toner supplied from the supply toner storing portion 63 is conveyed mainly by the first conveying portion 267*c*. The torque clutch 201 connects the first rotation shaft 267*e* and second rotation shaft 267*f*. The first rotation shaft 267*e*, torque clutch 201, and second rotation shaft 267*f* constitute a rotation shaft 267*g* of the first toner supply spiral 267. The torque clutch 201 is configured to transmit a rotational force applied to the first rotation shaft 267*e* to the second rotation shaft 267*f*, and slip when a rotational load exceeding a predetermined value is applied to the second rotation shaft 267*f*. The torque clutch 201 slips between the first rotation shaft 267*e* and the second rotation shaft 267*f* when a torque exceeding a predetermined value occurs between the rotation shafts 267*e* and 267*f*.

Here, a drive unit (not illustrated) applies a rotational driving force to the first rotation shaft 267*e*, on which the paddles 67*b* are formed, and the rotational driving force is further transmitted through the torque clutch 201 to the second rotation shaft 267*f*, on which the spiral 67*a* is formed. When the second rotation shaft 267*f*, on which the spiral 67*a* is formed, is subjected to a load torque exceeding a predetermined value, the rotation of the second rotation shaft 267*f* stops due to the operation of the torque clutch 201.

Figure 15A:
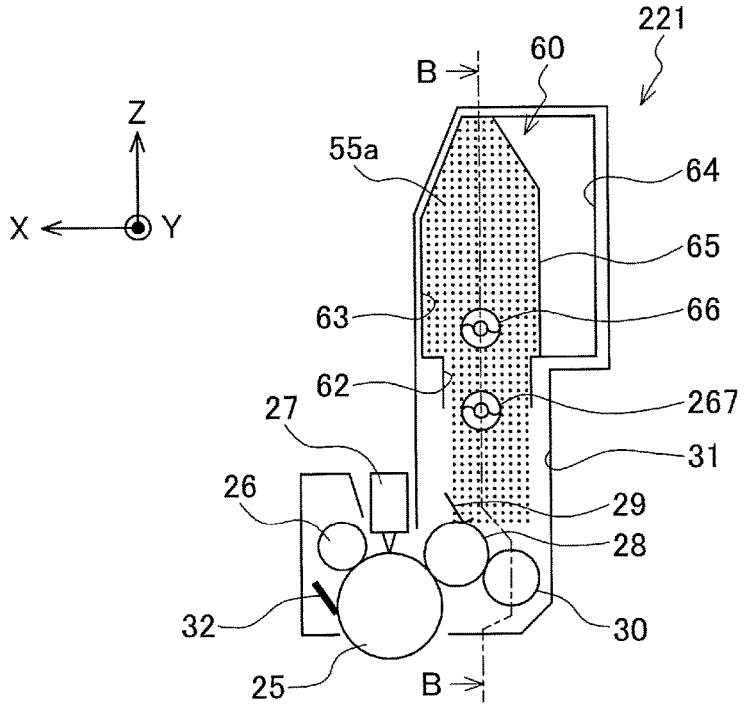
FIGS. 15A and 15B are state explanation diagrams schematically illustrating the spatial connection between the image forming unit and the cartridge toner storing portion of the toner cartridge corresponding to the image forming unit similarly to FIGS. 14A and 14B, and additionally illustrating toners stored in a supply toner storing portion of the image forming unit and the cartridge toner storing portion, FIGS. 15A and 15B illustrating a state where most of the toner remains in the supply toner storing portion of the image forming unit.
Figure 15B:
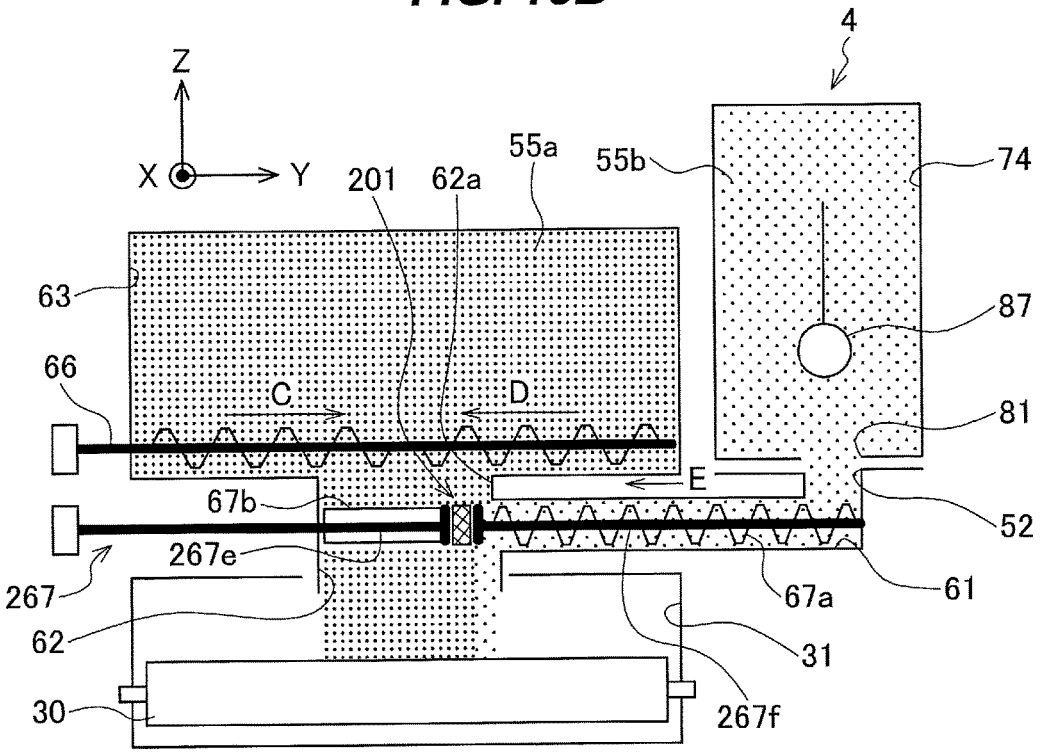
Figure 16A:
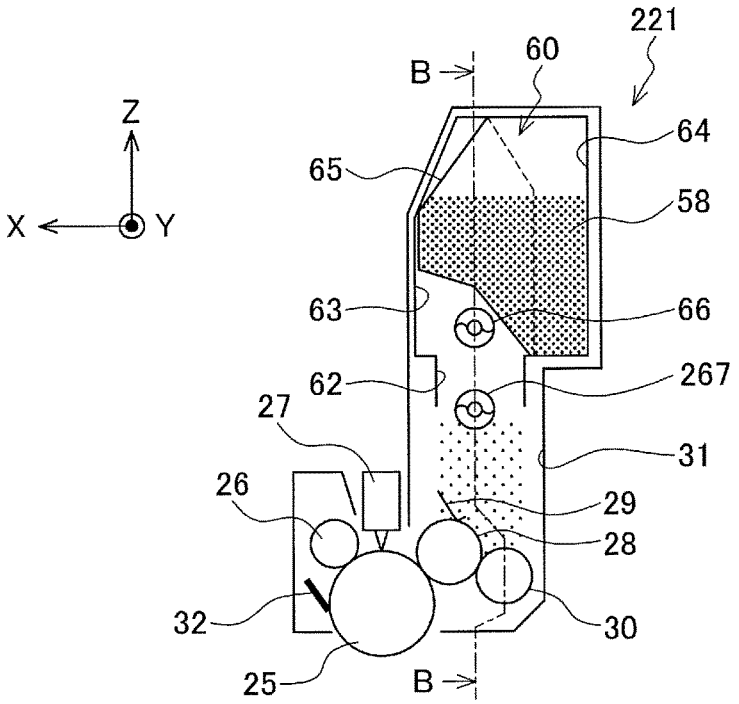
FIGS. 16A and 16B are state explanation diagrams similar to FIGS. 15A and 15B, and illustrate a state where little of the toner remains in the supply toner storing portion of the image forming unit.
Figure 16B:
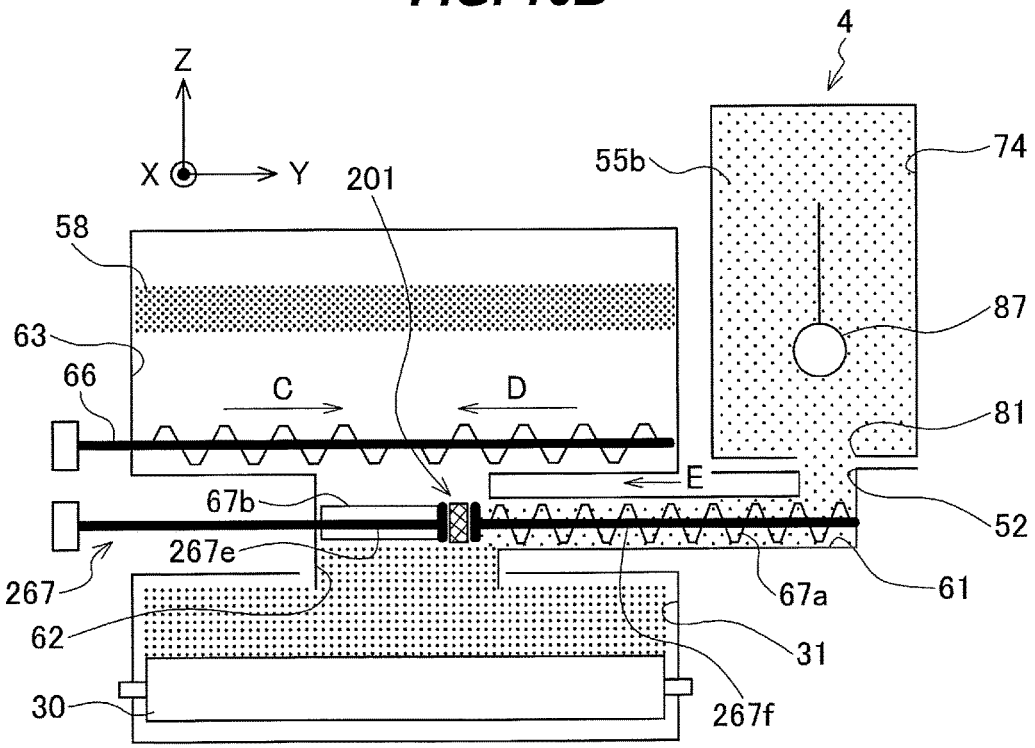

The operation of the torque clutch 201 will be described with reference to FIGS. 15A, 15B, 16A, and 16B. FIGS. 15A and 15B illustrate a state where most of the toner 55*a* remains in the supply toner storing portion 63 of the image forming unit 221. FIGS. 16A and 16B illustrate a state where little of the toner 55*a* remains in the supply toner storing portion 63 of the image forming unit 221.

When much of the toner 55*a* remains in the supply toner storing portion 63 as illustrated in FIGS. 15A and 15B, since a large amount of the toner 55*a* is supplied into the toner supply path 62 through the opening 62*a* of the toner supply path 62, the toner supply path 62 is filled with the toner 55*a* and in a high pressure state. At this time, it is difficult for the toner 55*b* supplied from the cartridge toner storing portion 74 and conveyed by the spiral 67*a* in the direction of arrow E in FIG. 15B to enter the toner supply path 62. When the load applied to the second rotation shaft 267*f* conveying the toner 55*b* increases and exceeds the predetermined value, the torque clutch 201 operates and stops rotation of the second rotation shaft 267*f*, so that supply of the toner 55*b* from the cartridge toner storing portion 74 stops.

Then, as illustrated in FIGS. 16A and 16B, when the supply toner storing portion 63 becomes empty and the pressure in the toner supply path 62 due to the toner 55*a* decreases, the load applied to the second rotation shaft 267*f* for conveying the toner 55*b* decreases accordingly. When the load falls below a predetermined value, the torque clutch 201 engages and rotates the second rotation shaft 267*f*. Thereby, supply of the toner 55*b* from the cartridge toner storing portion 74 restarts and the toner 55*b* is conveyed into the toner supply path 62.

As above, the image forming apparatus of this embodiment can achieve the same advantages as the image forming apparatus of the first embodiment and further can prevent the spiral 67*a* of the first toner supply spiral 267 from breaking due to overload.

In the above description of the embodiments, the terms, such as "above", "below", "left", "right", "front", and "rear", for indicating positional relationships have been used. However, these are for convenience, and not intended to absolutely limit the positional relationships in a state where the image forming apparatus is placed.

The present invention is not limited to the embodiments described above; it can be practiced in various other aspects without departing from the invention scope.

In each of the above embodiments, the image forming apparatus has been described using the color printer as an example. However, the present invention is also applicable to other apparatuses, such as a monochrome printer, a copier, a facsimile machine, or a multi-function peripheral integrating the functions of these devices.

What is claimed is:

1. An image forming apparatus comprising:

an image forming unit including:

a toner image forming unit that forms a toner image; and a toner storing portion including a first supply toner storing portion that stores a first supply toner, a waste toner storing portion that stores a waste toner, and a movable partition that separates the first supply toner storing portion and the waste toner storing portion; and a toner cartridge that is removably attached to the image forming unit and includes a second supply toner storing portion that stores a second supply toner having the same color as the first supply toner, wherein the image forming unit further includes:

a first supply portion for supplying the first supply toner stored in the first supply toner storing portion to the toner image forming unit;

a second supply portion for supplying the second supply toner stored in the second supply toner storing portion to the toner image forming unit; and a first conveying member that conveys the first supply toner supplied through the first supply portion and the second supply toner supplied through the second supply portion, to the toner image forming unit.

2. The image forming apparatus of claim 1, wherein the toner storing portion further includes a second conveying member that conveys the first supply toner stored in the first supply toner storing portion to the first supply portion.

3. The image forming apparatus of claim 1, wherein when the first supply toner exists in the first supply toner storing portion and the second supply toner exists in the second supply toner storing portion, an amount of the first supply toner supplied to the toner image forming unit per unit time is greater than an amount of the second supply toner supplied to the toner image forming unit per unit time.

4. The image forming apparatus of claim 1, wherein the first conveying member includes:

a first conveying portion that includes a first rotation shaft and a paddle formed on the first rotation shaft, and conveys the first supply toner; and a second conveying portion that includes a second rotation shaft connected to the first rotation shaft and a spiral formed on the second rotation shaft, and conveys the second supply toner.

5. The image forming apparatus of claim 4, wherein an amount of toner conveyed by the first conveying portion during one revolution of the first conveying member is greater than an amount of toner conveyed by the second conveying portion during one revolution of the first conveying member.

6. The image forming apparatus of claim 4, wherein the first conveying member further includes a torque clutch that connects the first rotation shaft and the second rotation shaft, and wherein the torque clutch is configured to transmit a rotational force applied to the first rotation shaft to the second rotation shaft and slip when a rotational load exceeding a predetermined value is applied to the second rotation shaft.

7. The image forming apparatus of claim 1, wherein the movable partition is configured to increase a capacity of the waste toner storing portion as an amount of the first supply toner stored in the first supply toner storing portion decreases.

8. An image forming apparatus comprising:

a plurality of image forming units each including:

a toner image forming unit that forms a toner image; and a toner storing portion including a first supply toner storing portion that stores a first supply toner, a waste toner storing portion that stores a waste toner, and a movable partition that separates the first supply toner storing portion and the waste toner storing portion; and a toner cartridge that is removably attached to the plurality of image forming units and includes a plurality of second supply toner storing portions corresponding to the plurality of image forming units on a one-to-one basis, the plurality of second supply toner storing portions each storing a second supply toner having the same color as the first supply toner stored in the first supply toner storing portion of the corresponding image forming unit, wherein each of the plurality of image forming units further includes:

a first supply portion for supplying the first supply toner stored in the first supply toner storing portion to the toner image forming unit;

a second supply portion for supplying the second supply toner stored in the corresponding second supply toner storing portion to the toner image forming unit; and a first conveying member that conveys the first supply toner supplied through the first supply portion and the second supply toner supplied through the second supply portion, to the toner image forming unit.

9. The image forming apparatus of claim 8, wherein the first supply toners stored in the first supply toner storing portions of the plurality of image forming units have different colors.

10. The image forming apparatus of claim 8, wherein in each of the plurality of image forming units, the movable partition is configured to increase a capacity of the waste toner storing portion as an amount of the first supply toner stored in the first supply toner storing portion decreases.

* * * * *